US006996916B2

(12) United States Patent
Cafaro

(10) Patent No.: US 6,996,916 B2
(45) Date of Patent: Feb. 14, 2006

(54) VARIABLE ION HAIR STYLING APPLIANCES

(75) Inventor: Michael Cafaro, El Paso, TX (US)

(73) Assignee: Helen of Troy Limited, Bridgetown (BB)

( * ) Notice: Subject to any disclaimer, the term of this patent is extended or adjusted under 35 U.S.C. 154(b) by 0 days.

(21) Appl. No.: 10/796,401

(22) Filed: Mar. 9, 2004

(65) Prior Publication Data

US 2005/0198853 A1 Sep. 15, 2005

(51) Int. Cl.
*A45D 20/28* (2006.01)

(52) U.S. Cl. ..... 34/96; 34/97; 219/383; 392/385

(58) Field of Classification Search ..... 34/96, 34/97, 283, 553, 554; 219/383; 392/385
See application file for complete search history.

(56) References Cited

U.S. PATENT DOCUMENTS 6,393,718 B1 * 5/2002 Harris et al. ..... 34/96
6,792,692 B1 * 9/2004 Takizawa et al. ..... 34/96

* cited by examiner

*Primary Examiner*—Jiping Lu
(74) *Attorney, Agent, or Firm*—Vinson & Elkins L.L.P.

(57) ABSTRACT

A hair drying/styling appliance includes an ion emitting circuit which directs ion onto the hair of a user, and in which the level of ion output is variable and adjustable by a user. In preferred embodiments indicators such as a series of lights on the housing indicate the level of ion output.

9 Claims, 4 Drawing Sheets

VARIABLE ION HAIR STYLING APPLIANCES

SUMMARY

The present disclosure relates to hair styling/drying devices such as hot air dryers, hot air brushes, curling irons and flat irons that incorporate negative ion technology, and more particularly, devices in which the negative ion output is adjustable by the user. The adjustment of ion flow allows users with different hair types to adjust the ion flow to the correct levels for their particular hair. For example, the low range ion flow is appropriate for fine hair, the medium range setting is appropriate for normal hair and the high range setting is preferably used for thick hair. In this way, the user's hair can be dried and styled without the frizzy effects caused by static electricity, and further the correct ion flow prevents the overhydration of thinner hair while maintaining volume.

In preferred embodiments of the present disclosure, a hair drying/styling appliance is provided with a voltage generator module along with a control circuit that allows for variable negatively charged ion output. The control circuit allows the negative electrostatic output to range from low to medium to high by the use of a variable output device such as a rheostat or variable resistor that is controlled by the user of the appliance. The control circuit also allows the variable electrostatic output to be visibly indicated by a series of lights or other visual indicators. As the negative ion output is increased, the number of illuminated lights or other visual indicators increases. In this way, the user can quickly and easily monitor the amount of negative ion output and adjust it accordingly.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1:
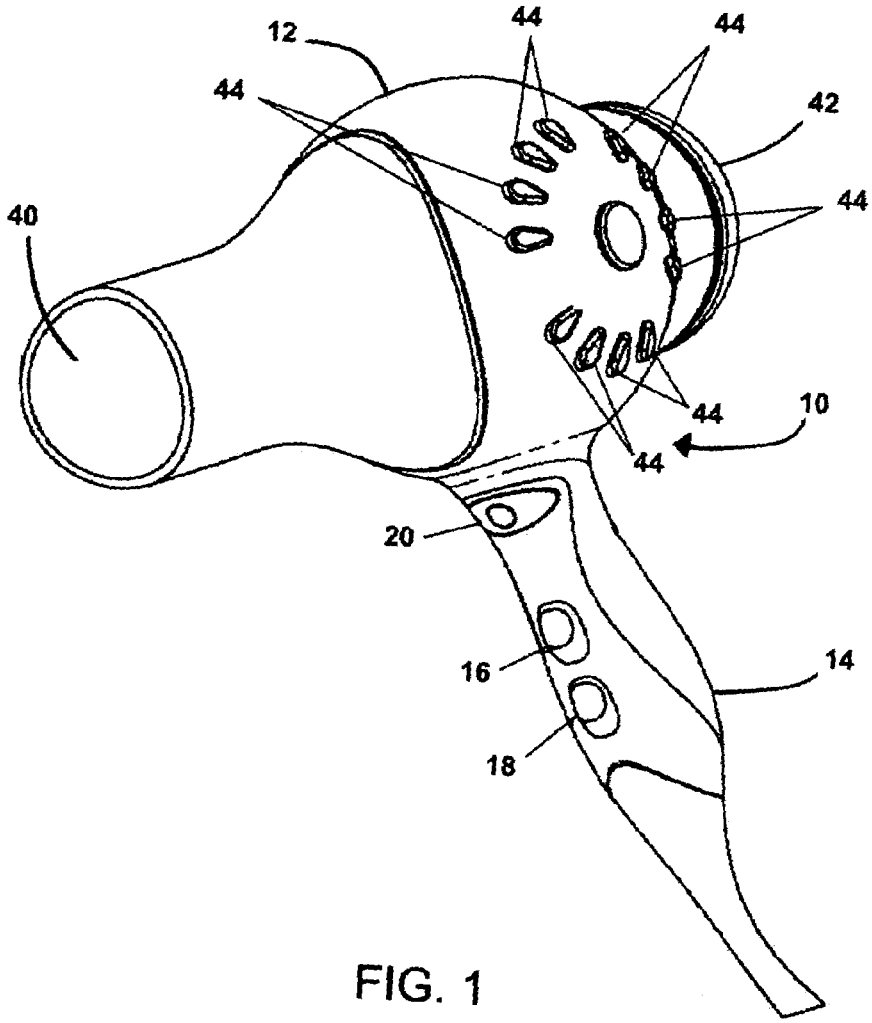
FIG. 1 is a perspective view of a preferred embodiment of a hair drying/styling device.

An embodiment of the present invention may be a hair dryer 10 as shown in perspective view in FIG. 1. It is understood that other drying/styling appliances such as hot air brushes are also included within the scope of the present disclosure. The hair dryer 10 includes a main body portion housing 12 and a handle portion 14. The handle portion includes switches for power/fan speed 16 and temperature 18. In preferred embodiments, the fan speed switch 16 includes settings of Off, Low, and High. The temperature switch 18 preferably provides for Hot, Warm or Cool temperature settings. The handle portion 14 may also include a cool switch 20, which when activated causes the fan to discharge air without activating the heating coils.

Figure 2:
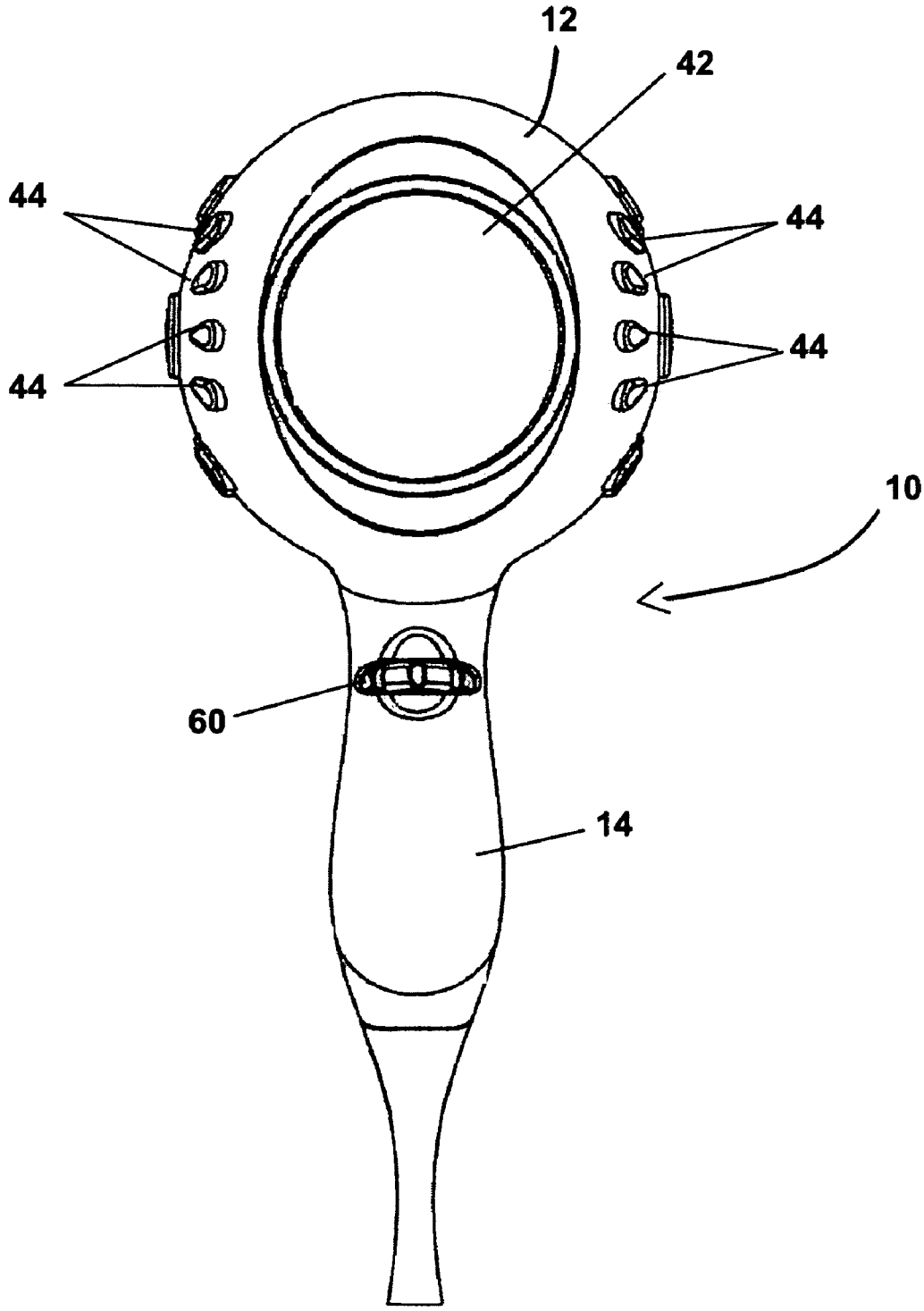
FIG. 2 is a rear elevation view of the embodiment shown in FIG. 1.

The housing 12 provides an inlet 42, and an outlet 40 for hot air flow, and the outlet is configured for attachment of an air flow concentrator, a diffuser, or other standard attachments known in the art. Also shown on the side of the housing is a series of lights 44 that indicate the level of ion output. In the embodiment shown, sets of four lights each on each side of the device indicate the range of ion flow. For example, if the ion flow is set within the low range, then one set of four lights per side would be illuminated, if the ion flow is set within the medium range, then two sets of four lights per side would be illuminated, and if the ion flow is set within the high range, then three sets of four lights per side would be illuminated. As described, in certain embodiments, and as shown in FIG. 2, the sets of lights or visual indicators may be on both sides of the housing, so while a description of the arrangement of lights may be for one side of the device, the device contains a corresponding indicator system on both sides of the device. It is understood that any type of visual display could be used to indicate the ion flow. These would include neon, incandescent, fluorescent, light emitting diodes (LED), liquid crystal displays (LCD), or any other type of visual display known in the art. In certain embodiments, three neon lights are disposed in the housing beneath translucent windows that transmit the light from the underlying light sources. It is also understood that each light source may be associated with a single or multiple windows. In certain embodiments, each illuminated neon appears as four lights on the surface of the housing. The underlying light may be colored, the translucent windows may be colored, or neither may be colored. In certain embodiments, all the lights may be the same color, or they may be different colors to indicate different levels of ion flow.

A rear view of a preferred embodiment is shown in FIG. 2. In this view, the ion flow adjustment device 60 can be seen. This device 60, which may be configured as a wheel allows the selection of low, medium or high ion flow as described above. Some embodiments may include discrete "stops" for specific levels of ion flow, or a continuous range may be available from the lowest to the highest setting.

Figure 3:
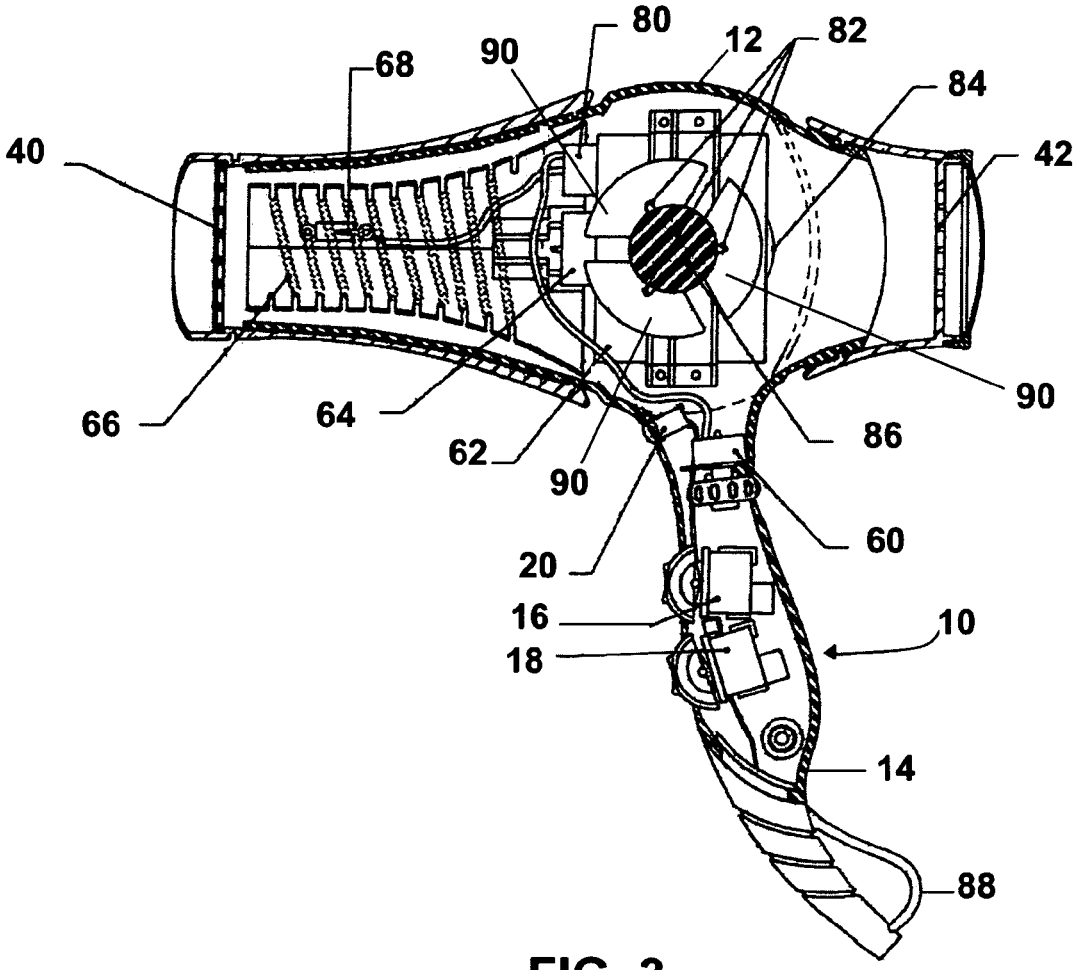
FIG. 3 is a cross section view of the embodiment shown in FIG. 1.
Figure 4:
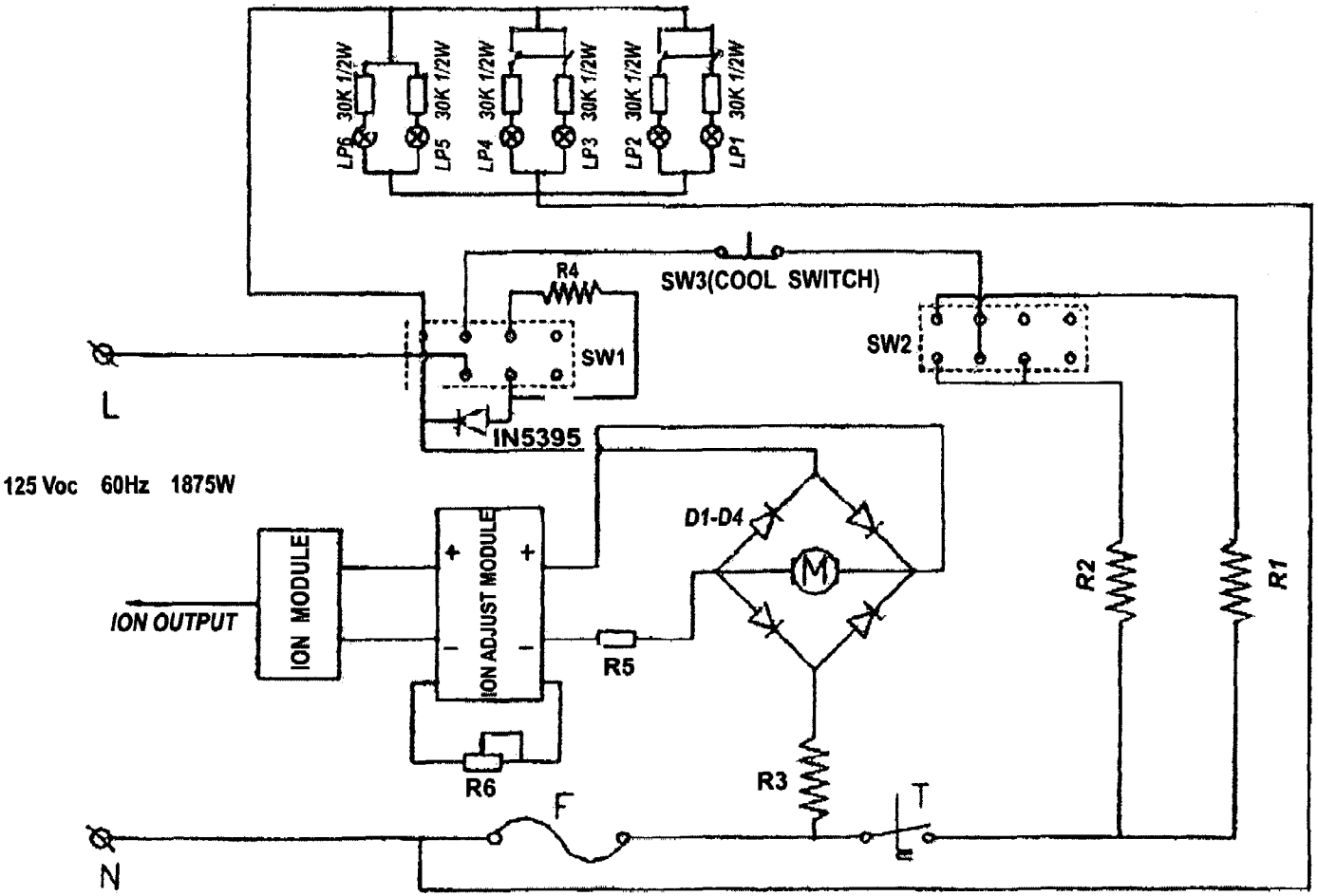
FIG. 4 is an exemplary electronic circuit for use in a hair dryer embodiment.

A cross section view of a preferred embodiment is shown in FIG. 3. The embodiment shown is a hair dryer 10, the housing 12 of which contains heating coils 66 and a fan 84, contained in fan housing 62, and driven by motor 64, both controlled by switches 16, 18 as in conventional hair dryers. The embodiment shown in FIG. 3 also contains a system for directing negative ions onto the hair of a user. This system includes an ion generator 80 that is connected to ion emitter 68. The ion emitter is disposed within the region of the heating coils 66 and the emitted ions are directed out the air outlet 40 with the flow of air created by the fan 84. The ion generator is connected to, and controlled by the ion selection regulator 60.

As described above, a preferred embodiment includes a series of lights to indicate the level of ion output that the user has selected. Three indicator lights 82 are shown in FIG. 3. The indicator lights are each disposed over a reflector 90 in order to illuminate translucent windows 44 as described. In the embodiment shown, each set of four windows is illuminated by a single neon bulb 82. Also shown in FIG. 3 is a printed circuit board 86 containing the electronic circuitry to control the described functions.

In the embodiment shown in FIG. 3, the handle portion 14 also includes a loop 88 that can be used to hang the device on a hook. The handle also provides a entry for an electrical cord which is not shown in the drawing.

All of the apparatus disclosed and claimed herein can be made and executed without undue experimentation in light of the present disclosure. While the apparatus of this invention have been described in terms of preferred embodiments, it will be apparent to those of skill in the art that alternative embodiments can be made by one of skill in the relevant art, without undue experimentation. All such similar substitutes, modifications and species of the disclosed embodiments apparent to those skilled in the art are deemed to be within the spirit, scope and concept of the invention as defined by the appended claims.

What is claimed is:

1. A hair drying or styling appliance comprising:

a housing;

a heating element;

a fan for discharging heated air from the appliance;

an outlet for directing heated air to the desired location;

an ion emitter device comprising a positive and a negative electrode and positioned to emit ions into the flow of discharging air;

an ion generator connected to the ion emitter;

a variable ion output regulator connected to the ion generator and comprising a control for adjusting the ion output from a low level to a high level; and a plurality of indicator lights connected to be responsive to the ion generator effective to indicate the level of ion output.

2. The appliance of claim 1, further defined as a hair dryer.

3. The appliance of claim 1, wherein the lights are neon lights.

4. The appliance of claim 1, wherein the ion generator is adjustable through three ranges of output, and wherein each range is indicated by illumination of one or more lights.

5. The appliance of claim 1, wherein the plurality of lights comprises three lights on each side of the housing, wherein the ion generator output is adjustable, and further wherein within the low output range, one light on each side of the housing is illuminated, within the medium output range, two light on each side of the housing is illuminated and within the high output range, three lights on each side of the housing are illuminated.

6. The appliance of claim 5 comprising multiple translucent windows in the housing covering the lights such that each light illuminates a plurality of translucent windows.

7. The appliance of claim 6, wherein each light illuminates four translucent windows.

8. The appliance of claim 6, wherein the lights are white lights and the translucent windows are colored.

9. The appliance of claim 1, wherein the lights are colored lights.

* * * * *